US008065875B2

(12) United States Patent
Vigholm et al.

(10) Patent No.: US 8,065,875 B2
(45) Date of Patent: Nov. 29, 2011

(54) METHOD FOR SPRINGING A MOVEMENT OF AN IMPLEMENT OF A WORK MACHINE

(75) Inventors: Bo Vigholm, Stora Sundby (SE); Markku Palo, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 611 days.

(21) Appl. No.: 12/158,054

(22) PCT Filed: Jan. 16, 2007

(86) PCT No.: PCT/SE2007/000040

§ 371 (c)(1),
(2), (4) Date: Jun. 19, 2008

(87) PCT Pub. No.: WO2007/081280

PCT Pub. Date: Jul. 19, 2007

(65) Prior Publication Data

US 2008/0295505 A1 Dec. 4, 2008

Related U.S. Application Data

(60) Provisional application No. 60/759,996, filed on Jan. 18, 2006.

(30) Foreign Application Priority Data

Jan. 16, 2006 (SE) ..... 0600087

(51) Int. Cl.
*F15B 11/24* (2006.01)
*E02F 9/22* (2006.01)

(52) U.S. Cl. ..... 60/469; 60/476

(58) Field of Classification Search ..... 60/469, 60/474, 475, 476

See application file for complete search history.

(56) References Cited

U.S. PATENT DOCUMENTS 3,473,325 A * 10/1969 Vargo ..... 60/469
5,890,870 A * 4/1999 Berger et al. ..... 60/469
6,351,944 B1 3/2002 Fertig et al.

FOREIGN PATENT DOCUMENTS

EP 0440070 A2 8/1991
WO WO 2004007974 A1 * 1/2004

OTHER PUBLICATIONS

International Search Report from corresponding International Application No. PCT/SE2007/000040.

* cited by examiner

*Primary Examiner* — Thomas E Lazo
(74) *Attorney, Agent, or Firm* — WRB-IP LLP

(57) ABSTRACT

A method for springing a movement of an implement of a work machine during a movement of the work machine is provided, in which at least one hydraulic cylinder is connected to the implement for controlling its movements, comprising the steps of connecting a hydraulic machine to the hydraulic cylinder, and of controlling the hydraulic machine in response to a disturbance acting upon the implement during the movement of the work machine.

28 Claims, 4 Drawing Sheets

METHOD FOR SPRINGING A MOVEMENT OF AN IMPLEMENT OF A WORK MACHINE

BACKGROUND AND SUMMARY

The present invention relates to a method for springing a movement of an implement of a work machine during a movement of the work machine, in which at least one hydraulic cylinder is operatively connected to the implement. In other words, the invention relates to a method for damping the vibrations of the implement during the movement of the work machine.

In particular, the invention relates to springing of the load arm. For springing of the load arm, the lifting cylinders of the work machine are controlled. Springing of the load arm is used to increase the comfort for the driver and to reduce spillage of material from the implement (the bucket). With springing of the load arm, the load arm can move in relation to the body of the machine, resulting in two movable masses instead of one.

The invention will be described below in connection with a work machine in the form of a wheel loader. This is a preferred but in no way limiting application of the invention. The invention can also be used for other types of work machines (or work vehicles), such as an excavator loader (backhoe) and excavating machine.

WO 99/16981 describes a system for springing of the load arm. An accumulator is connected to a piston side of the hydraulic cylinder. A tank for hydraulic fluid is connected to a piston-rod side of the hydraulic cylinder. The system comprises a plurality of valves for controlling the function.

It is desirable to provide a method that provides a springing of the movement of the implement during transportation and that makes energy-efficient operation possible.

According to an aspect of the present invention, a method is provided for springing a movement of an implement of a work machine during a movement of the work machine, in which at least one hydraulic cylinder is operatively connected to the implement, comprising the steps of connecting a hydraulic machine to communication with the hydraulic cylinder, and of controlling the hydraulic machine in response to a disturbance acting upon the implement during the movement. The springing method can, for example, be initiated by the operator moving a control in the cab of the vehicle.

The hydraulic cylinder is preferably adapted to move an implement in order to perform a work function. According to a first example, the hydraulic cylinder comprises a lifting cylinder for moving a load arm which is pivotably connected to a vehicle frame, the implement being arranged on the load arm. According to a second example, the hydraulic cylinder comprises a tilting cylinder for moving the implement which is pivotably connected to the load arm. According to a third example, the hydraulic cylinder is arranged to steer the vehicle when it is being driven.

The method preferably comprises the step of controlling the hydraulic machine in such a way that said springing of the movement of the implement is achieved.

According to yet another preferred embodiment, the method comprises the steps of detecting a parameter that is indicative of the position of the implement and of controlling the hydraulic machine in response to the detected position. For springing of the load arm, the position of the load arm is preferably detected. For example, the position of the piston rod is detected via a linear sensor or alternatively the angular position of the load arm can be detected via an angle sensor. The position parameter is preferably detected repeatedly, suitably essentially continuously, and the hydraulic machine is controlled in response to this.

According to yet another preferred embodiment, the method comprises the step of pressurizing the hydraulic cylinder to such an extent that the implement is brought to a home position. The hydraulic machine is preferably controlled continuously so that the implement is kept within a predetermined range around the home position.

According to yet another preferred embodiment, the method comprises the steps of detecting the position of the implement upon initiation of the method, of defining the detected position upon initiation as a home position and of controlling the hydraulic machine, when the hydraulic machine is connected to the hydraulic cylinder, in such a way that the implement is kept in the home position.

According to yet another preferred embodiment, the method comprises the step of supplying a corresponding quantity of hydraulic fluid to the hydraulic cylinder, in the event of a disturbance that results in an upward movement of the implement. At the same time, an opposite side of the hydraulic cylinder is drained. The drained hydraulic fluid can, for example, be taken back to the hydraulic machine or to the tank.

In a corresponding way, the method preferably comprises the step of draining at least a corresponding quantity of hydraulic fluid from the hydraulic cylinder, in the event of a disturbance that results in a downward movement of the implement. According to an example, a quantity of hydraulic fluid is drained that corresponds to the size of the disturbance acting upon the implement. In such a case, the implement returns directly to the home position. According to a variant, a greater quantity of hydraulic fluid is drained than the quantity that corresponds to the size of the disturbance acting upon the implement. In such a case, the implement reaches a level below the home position, before it is brought up again.

The method suitably comprises the step of connecting a first port on the hydraulic machine to a piston side of the hydraulic cylinder via a first line. In a corresponding way, the method preferably comprises the step of connecting a second port on the hydraulic machine to a piston-rod side of the hydraulic cylinder via a second line.

According to yet another preferred embodiment, the method comprises the step of allowing the hydraulic machine to be driven by a flow of hydraulic fluid from the hydraulic cylinder, in the event of a disturbance that results in a downward movement of the implement, and of regenerating the energy from the hydraulic machine via an electric machine.

Further preferred embodiments and advantages of the invention emerge from the following description.

BRIEF DESCRIPTION OF THE DRAWINGS

The invention will be described in greater detail below with reference to the embodiments shown in the accompanying drawings, in which.

DETAILED DESCRIPTION

Figure 1:
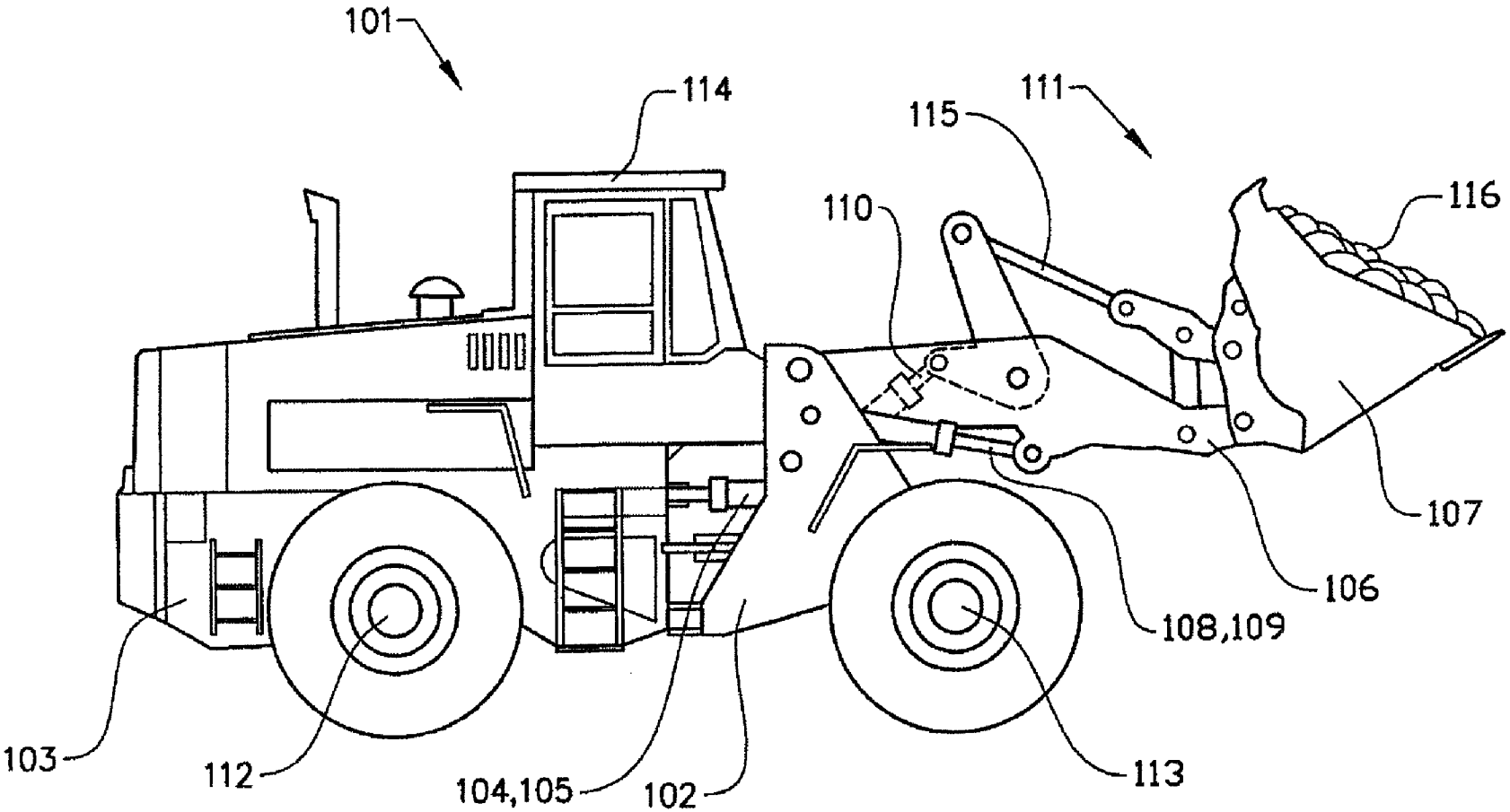
FIG. 1 shows a side view of a wheel loader.

FIG. 1 shows a side view of a wheel loader 101. The wheel loader 101 comprises a front vehicle part 102 and a rear vehicle part 103, which parts each comprise a frame and a pair of drive axles 112, 113. The rear vehicle part 103 comprises a cab 114. The vehicle parts 102, 103 are coupled together with one another in such a way that they can be pivoted in relation to one another about a vertical axis by means of two hydraulic cylinders 104, 105 which are connected to the two parts. The hydraulic cylinders 104, 105 are thus arranged on different sides of a center line in the longitudinal direction of the vehicle for steering, or turning the wheel loader 101.

The wheel loader 101 comprises an apparatus 111 for handling objects or material. The apparatus 111 comprises a lifting arm unit 106 and an implement 107 in the form of a bucket which is mounted on the lifting arm unit. Here, the bucket 107 is filled with material 116. A first end of the lifting arm unit 106 is coupled rotatably to the front vehicle part 102 for bringing about a lifting movement of the bucket. The bucket 107 is coupled rotatably to a second end of the lifting arm unit 106 for bringing about a tilting movement of the bucket.

The lifting arm unit 106 can be raised and lowered in relation to the front part 102 of the vehicle by means of two hydraulic cylinders 108, 109, which are each coupled at one end to the front vehicle part 102 and at the other end to the lifting arm unit 106. The bucket 107 can be tilted in relation to the lifting arm unit 106 by means of a third hydraulic cylinder 110, which is coupled at one end to the front vehicle part 102 and at the other end to the bucket 107 via a link arm system.

Figure 2:
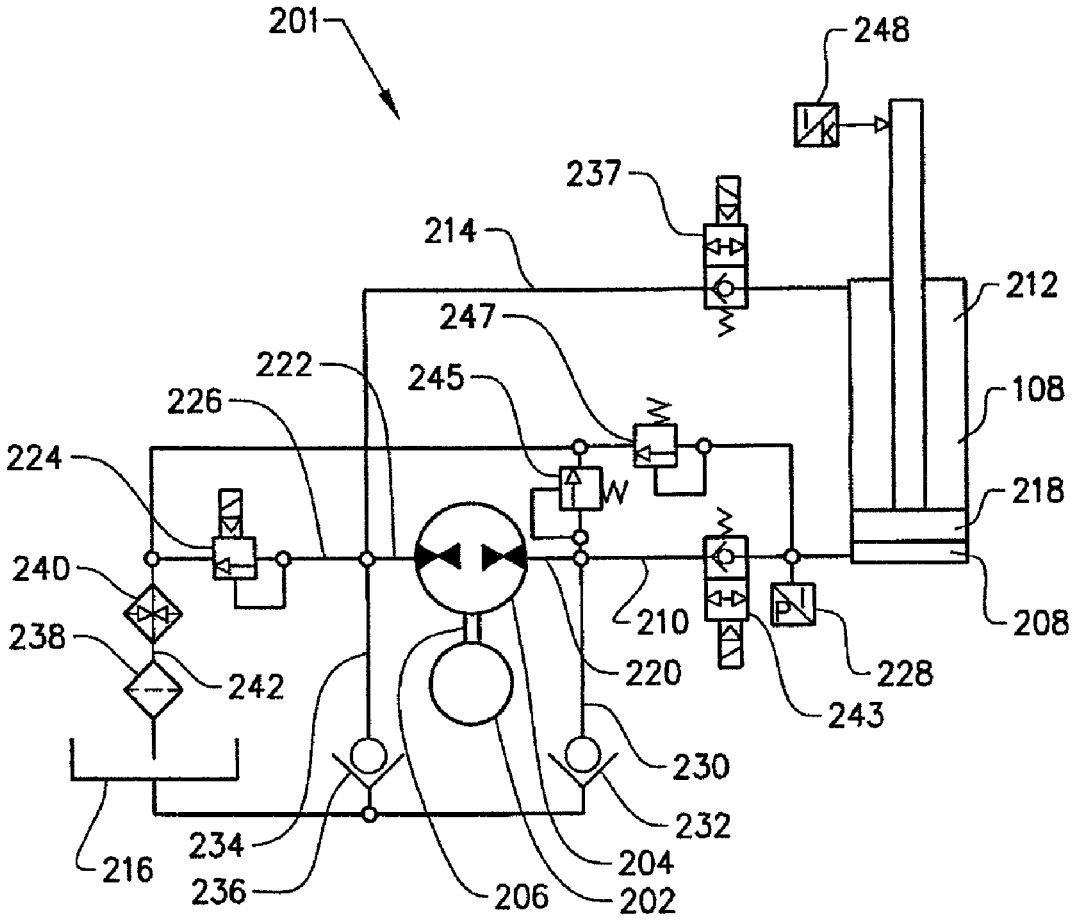
FIG. 2 shows an embodiment of a control system for carrying out springing of the load arm of the wheel loader.

FIG. 2 shows a first embodiment of a control system 201 for performing load-arm springing of the lifting arm 106, see FIG. 1. The hydraulic cylinder 108 in FIG. 2 therefore corresponds to the lifting cylinders 108, 109 (although only one cylinder is shown in FIG. 2).

The control system 201 comprises an electric machine 202, a hydraulic machine 204 and the lifting cylinder 108. The electric machine 202 is connected in a mechanically driving manner to the hydraulic machine 204 via an intermediate drive shaft 206. The hydraulic machine 204 is connected to a piston side 208 of the hydraulic cylinder 108 via a first line 210 and a piston-rod side 212 of the hydraulic cylinder 108 via a second line 214.

The hydraulic machine 204 is adapted to function as a pump, be driven by the electric machine 202 and supply the hydraulic cylinder 108 with pressurized hydraulic fluid from a tank 216 in a first operating state and to function as a motor, be driven by a hydraulic fluid flow from the hydraulic cylinder 108 and drive the electric machine 202 in a second operating state.

The hydraulic machine 204 is adapted to control the speed of the piston 218 of the hydraulic cylinder 108 in the first operating state. No control valves are therefore required between the hydraulic machine and the hydraulic cylinder for said control. More precisely, the control system 201 comprises a control unit 402, see FIG. 4, which is electrically connected to the electric machine 202 in order to control the speed of the piston of the hydraulic cylinder 108 in the first operating state by controlling the electric machine.

The hydraulic machine 204 has a first port 220 which is connected to the piston side 208 of the hydraulic cylinder via the first line 210 and a second port 222 which is connected to the piston-rod side 212 of the hydraulic cylinder via the second line 214. The second port 222 of the hydraulic machine 204 is moreover connected to the tank 216 in order to allow the hydraulic machine, in the first operating state, to draw oil from the tank 216 via the second port 222 and supply the oil to the hydraulic cylinder 108 via the first port 220.

The control system 201 comprises a means 224 for controlling pressure, which pressure means 224 is arranged on a line 226 between the second port 222 of the hydraulic machine 204 and the tank 216 in order to allow pressure build-up on the piston-rod side 212. More precisely, the pressure control means 224 comprises an electrically controlled pressure-limiting valve.

The control system 201 also comprises a sensor 228 for sensing pressure on the piston side 208 of the hydraulic cylinder 108.

The first port 220 of the hydraulic machine 204 is connected to the tank 216 via a first suction line 230. A means 232, in the form of a non-return valve, is adapted to allow suction of hydraulic fluid from the tank and obstruction of a hydraulic fluid flow to the tank through the suction line 230.

The second port 222 of the hydraulic machine 204 is connected to the tank 216 via a second suction line 234. A means 236, in the form of a non-return valve, is adapted to allow suction of hydraulic fluid from the tank and obstruction of a hydraulic fluid flow to the tank through the suction line 234.

A means 237 for opening/closing is arranged on the second line 214 between the second port 222 of the hydraulic machine 204 and the piston-rod end 212 of the hydraulic cylinder 108. This means 237 comprises an electrically controlled valve with two positions. In a first position, the line 214 is open for flow in both directions. In a second position, the valve has a nonreturn valve function and allows flow in only the direction toward the hydraulic cylinder 108. During lifting movement, the electric valve 237 is opened and the rotational speed of the electric machine 202 determines the speed of the piston 218 of the hydraulic cylinder 108. Hydraulic fluid is drawn from the tank 216 via the second suction line 234 and is pumped to the piston side 208 of the hydraulic cylinder 108 via the first line 210.

An additional line 242 connects the second port 222 of the hydraulic machine 204 and the tank 216.

A means 243 for opening/closing is arranged on the first line 210 between the first port 220 of the hydraulic machine 204 and the piston end 208 of the hydraulic cylinder 108. This means 243 comprises an electrically controlled valve with two positions. In a first position, the line 210 is open for flow in both directions. In a second position, the valve has a non-return valve function and allows flow in only the direction toward the hydraulic cylinder 108.

If the bucket 107 should stop suddenly during a lowering movement (which can happen if the bucket strikes the ground), the hydraulic machine 204 does not have time to stop. In this state, hydraulic fluid can be drawn from the tank 216 via the suction line 230 and on through the additional line 242.

The electrically controlled valves 237, 243 function as load-holding valves. They are closed in order that electricity is not consumed when there is a hanging load and also in order to prevent dropping when the drive source is switched off. According to an alternative, the valve 237 on the piston-rod side 212 is omitted. However, it is advantageous to retain the valve 237 because disturbances can lift the lifting arm 106.

A filtering unit 238 and a heat exchanger 240 are arranged on the additional line 242 between the second port 222 of the hydraulic machine 204 and the tank 216. An additional filtering and heating flow can be obtained by virtue of the hydraulic machine 204 driving a circulation flow from the tank 216 first via the first suction line 230 and then via the additional line 242 when the lifting function is in a neutral position. Before the tank, the hydraulic fluid thus passes through the heat exchanger 240 and the filter unit 238.

There is another possibility for additional heating of the hydraulic fluid by pressurizing the electrically controlled pressure limiter 224 at the same time as pumping-round takes place to the tank in the way mentioned above. This can of course also take place when the lifting function is used.

In addition, the electrically controlled pressure limiter 224 can be used as a back-up valve for refilling the piston-rod side 212 when lowering is carried out. The back pressure can be varied as required and can be kept as low as possible, which saves energy. The hotter the oil, the lower the back pressure can be, and the slower the rate of lowering, the lower the back pressure can be. When there is a filtration flow, the back pressure can be zero.

A first pressure-limiting valve 245 is arranged on a line which connects the first port 220 of the hydraulic machine 204 to the tank 216. A second pressure-limiting valve 247 is arranged on a line which connects the piston side 208 of the hydraulic cylinder 108 to the tank 216. The two pressure-limiting valves 245, 247 are connected to the first line 210 between the hydraulic machine 204 and the piston side 208 of the hydraulic cylinder 108 on different sides of the valve 243. The two pressure-limiting valves 245, 247, which are also referred to as shock valves, are spring-loaded and adjusted to be opened at different pressures. According to an example, the first pressure-limiting valve 245 is adjusted to be opened at 270 bar, and the second pressure-limiting valve 247 is adjusted to be opened at 380 bar.

When the work machine 101 is driven toward a heap of gravel or stones and/or when the implement is lifted/lowered/tilted, the movement of the bucket may be counteracted by an obstacle. The pressure-limiting valves 245, 247 then ensure that the pressure is not built up to levels which are harmful for the system.

According to a first example, the bucket 107 is in a neutral position, that is to say stationary in relation to the frame of the front vehicle part 102. When the wheel loader 101 is driven toward a heap of stones, the second pressure limiter 247 is opened at a pressure of 380 bar.

During ongoing lowering, the valve 243 on the first line 210 between the hydraulic machine 204 and the piston side 208 of the hydraulic cylinder 108 is open. When the lifting arm 106 is lowered, the first pressure limiter 245 is opened at a pressure of 270 bar. If a disturbance should force the loading arm 106 upward during a lowering operation with power down, the pressure limiter 224 on the line 226 between the second port 222 of the hydraulic machine 204 and the tank 216 is opened.

According to an alternative to the pressure-limiting valves 245, 247 being adjusted to be opened at a predetermined pressure, the pressure-limiting valves can be designed with variable opening pressure. According to a variant, the pressure-limiting valves 245, 247 are electrically controlled. If electric control is used, only one valve 247 is sufficient for the shock function. This valve 247 is controlled depending on whether the valve 243 is open or closed. The opening pressure can be adjusted depending on activated or non-activated lifting/lowering function and also depending on the cylinder position.

A method for springing of the load arm and regeneration of energy in the event of a movement of the implement 107 during a movement of the work machine 101 will be described below with reference to FIG. 2. The method can be said to consist of or comprise an active springing system for the lift function. The method can either be selected by an operator via a control in the cab, such as a knob or lever, or can be initiated automatically.

A sensor 248 is arranged to detect the position of the lifting arm 106 in relation to the frame of the front part 102 of the vehicle. The sensor 248 is here arranged to detect the position of the piston rod. Alternatively, the sensor 248 could detect the angular position of the load arm 106 in relation to the frame. The sensor 248 detects the position of the implement repeatedly, essentially continuously, and produces corresponding signals.

A control unit 402 (see FIG. 4) receives the position signals from the sensor 248. The control unit 402 is normally called a CPU (Central Processing Unit) and comprises a microprocessor and a memory.

The position of the load arm 106 is stored in the memory before the function is activated. Upon activation of the function, both the valves 237 and 243 are opened on both sides of the lifting cylinder 108. The hydraulic machine 204 is controlled in such a way that a pressure is supplied to the hydraulic cylinder 108 that is such that the implement 107 is brought to a home position. The load arm 106 is thus held in position with a certain torque.

During movement of the wheel loader 101, that is to say during transportation, the load arm 106 will be acted upon by vertical forces, as a result of the weight of the load and unevenness in the ground, and will move up and down. The sensor 248 records such disturbances that result in the load arm 106 being moved from the home position.

If a disturbance results in the lifting arm 106 moving upward, the control unit 802 records this. The control unit controls the hydraulic machine 204 (via the electric machine 202) so that the hydraulic machine turns with a certain torque and refills the piston side 208 with hydraulic fluid. The applied torque decreases, depending on how far the lifting arm 106 is from the home position. A springing function is thereby achieved.

In the event of a disturbance that results in a downward movement of the implement 107, the control unit 802 sends a signal to the electric machine 202 that allows the hydraulic machine 204 to be driven by a flow of hydraulic fluid from the hydraulic cylinder 108, and the energy from the hydraulic machine 204 is regenerated in the electric machine 202. When the lifting arm 106 moves downward, it passes through the home position, whereby the reverse torque of the electric machine 204 increases, so that the movement of the lifting arm is retarded and finally ceases. Following this, oil is pumped into the cylinder 108 so that the lifting arm 106 moves upward again.

The hydraulic cylinder 108 is controlled continuously, so that the implement 107 is kept within a predetermined range around the home position. In addition, adjustment is carried out continuously between the instances of a disturbance acting upon the implement, so that the load arm 106 does not deviate too far from the home position.

If the instances of a disturbance acting upon the implement are few in number, the valve 243 on the piston side 208 can be closed temporarily in order to save the energy that is required to hold the load. The valve 243 can be kept closed as long as no downward movement takes place. The valve 243 can thus be controlled actively and continuously to achieve energy-efficient operation.

The function also damps shocks that arise through disturbances such as, for example, hitting something with the bucket 107.

According to a further development, pressure sensors are used to record the sequence of pressure variations that arise in the event of a disturbance acting upon the implement. If pressure sensors are used, the valve 243 on the piston side 208 can, if required, be closed, provided that no lowering movement takes place (this depends on how quickly it can open in the event of a disturbance acting upon the implement). The disturbance acting upon the implement can, of course, also be recorded by a combination of position sensors and pressure sensors.

The hydraulic machine 204 is controlled in such a way that a springing function is achieved. In other words, if a disturbance urges the lifting arm 106 downward, the hydraulic machine 204 regenerates electricity and, at the same time, the torque is increased so that retarding of the movement takes place (like the action of a spring). A function for controlling the movement (in this case, the spring characteristic) can depend on a plurality of different parameters and can have various embodiments.

According to a preferred embodiment, the spring characteristics are dependent upon the following parameters:

1) The Level of the Disturbance Force Acting Upon the Implement

The same spring path is obtained for the same disturbance force acting upon the implement (irrespective of the weight of the load). The greater the disturbance force acting upon the implement, the longer the spring path. The disturbance force acting upon the implement can be recorded by a pressure sensor or as a derivate of the position sensor.

2) The Weight of the Load

It is possible, for example, to measure the pressure in the lifting cylinder and, if required, in the tilting cylinder. According to a first variant, the springing is controlled in such a way that the heavier the detected load, the shorter the spring path. According to a second variant, the springing is controlled in such a way that the lighter the detected load, the shorter the spring path.

3) Type of Implement

The computer records the type of implement (bucket, pallet fork, timber grab, etc) in any known way.

4) Type of Work being Carried Out

There are different characteristics associated with whether the machine is being driven (transportation) or whether work is being carried out with the function. For example, this could be indicated by the speed of the machine and/or by whether any movement of a lever takes place.

Said function for controlling the movement does not necessarily have to resemble a spring. The spring force increases with increased stroke length. According to a variant, a constant force (and hence constant torque) can be utilized. According to yet another variant, the springing constant can be changed, dependent upon the displacement of the hydraulic machine or the movement of the hydraulic cylinder.

The damping in the system is determined by the size of the torque that the pump applies when the unit is to be raised again after it has been urged downwards. This applied torque (spring characteristic) can also be a function of the abovementioned parameters.

The damping can be explained as the characteristic of the quantity of energy that is regenerated. The degree of damping is a combination of the size of the quantity of energy that is regenerated, the pressure drop in the system and the friction in the system.

For example, the position of the piston rod in the lifting cylinder is detected by a linear sensor or, alternatively, the angle of the load arm is detected by an angle sensor and the springing and/or damping of the lift function is controlled in response to the position. According to an alternative or in addition, the position of the implement is detected, for example by the position of the piston rod in the tilting cylinder or by an angle sensor, and the springing and/or damping of the lift function is controlled in response to the position. The position parameter is preferably detected repeatedly, suitably essentially continuously, and the springing/damping is controlled correspondingly.

According to yet another alternative, the speed of the work machine, the current work being carried out by the work machine, the type of implement that is arranged on the work machine, and/or a mode selected by the driver is detected and the springing and/or damping of the lift function is controlled correspondingly. By "work being carried out" is meant here an activity, such as handling/transportation of chippings, gravel, rubble, timber, pallets, snow-clearing, etc. By "type of implement" is meant here different implements, such as bucket, pallet forks, grab arms for timber etc. The type of implement can, for example, be detected automatically or can be selected manually by the driver. The work being carried out can either be determined automatically during operation of the machine or can be selected manually by the driver. Consequently, by mode is meant either work being carried out or type of implement. A combination of a plurality of the abovementioned parameters is preferably used to determine how the springing/damping is to be controlled.

Figure 3:
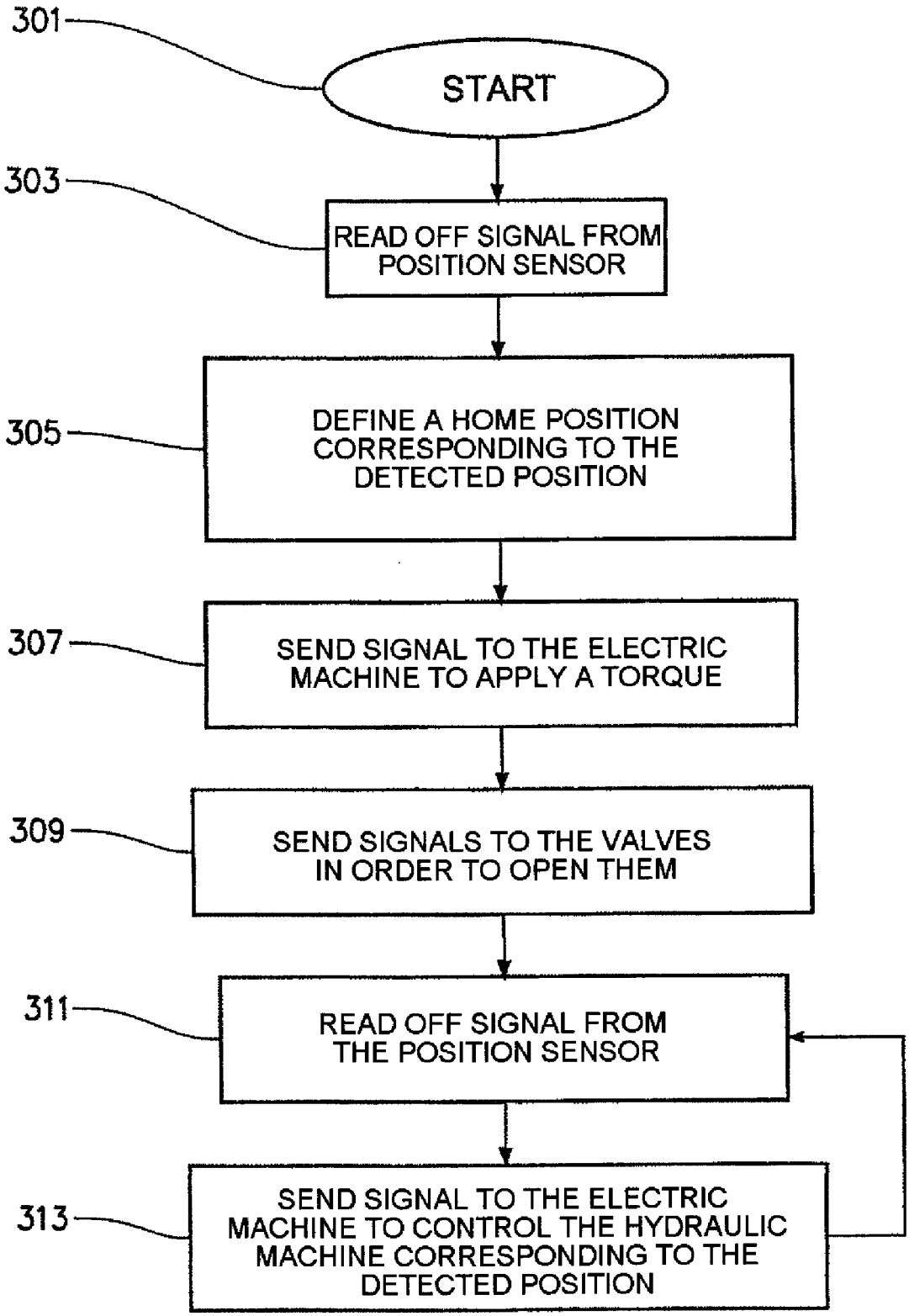
FIG. 3 shows a flow diagram for the springing of the load arm according to a first example.

FIG. 3 illustrates a flow diagram for the logic circuit in the method for the springing of the load arm according to an alternative. The logic circuit commences at the initial block 301 when a signal is received from a control 406 to the effect that springing of the load arm is to be activated. Following this, the control unit continues to block 303, where a signal from the sensor 248 that detects the position of the piston rod is read off. In the next block 305, a home position is defined, corresponding to the detected position of the piston rod. A signal is sent to the electric machine 202 in order to apply a torque to the hydraulic machine 204 so that the implement will be held in the home position, see block 307. In addition, signals are sent to the valves 237, 243 in order to open these, see block 309, and thereby connect the hydraulic machine to the piston side and the piston-rod side. Following this, signals from the sensor 248 that detects the position of the piston rod are read off continuously, see block 311, and the electric machine 202 is controlled in response to the detected positions, see block 313.

Figure 4:
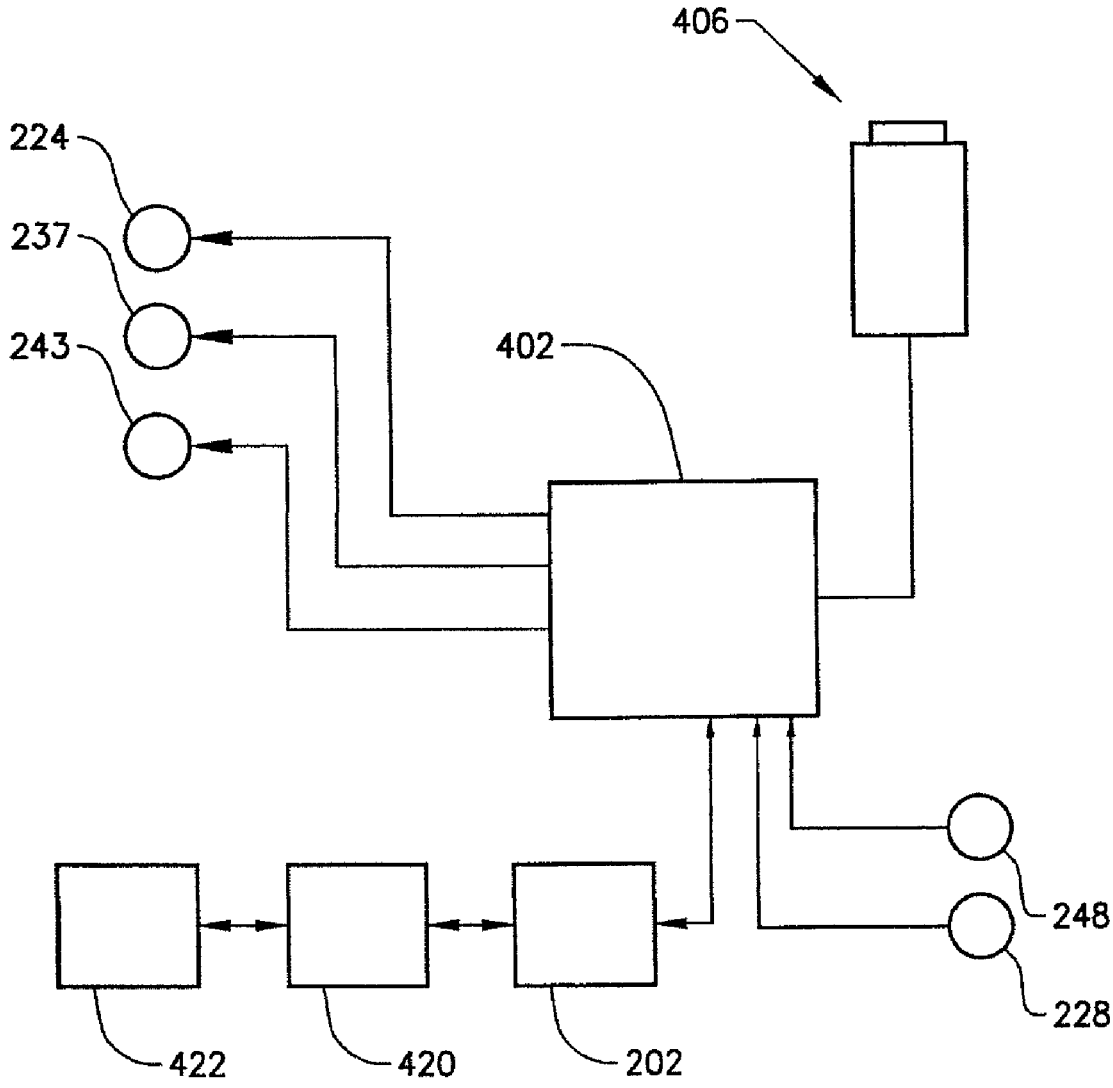
FIG. 4 shows a control system for controlling one or more of the functions of the wheel loader.

FIG. 4 shows a control system for the lowering function. An element or control 406 for activating the springing of the load arm is arranged in the cab 114 for manual operation by the driver and is electrically connected to the control unit 402.

The electric machine 202 is electrically connected to the control unit 402 in such a way that it is controlled by the control unit and can supply signals about the operating conditions to the control unit.

The control system comprises one or more energy storage means 420 connected to said electric machine 202. The energy storage means 420 can consist of or comprise a battery or a supercapacitor, for example. The energy storage means 420 is adapted to provide the electric machine with energy when the electric machine 202 is to function as a motor and drive its associated pump 204. The electric machine 202 is adapted to charge the energy storage means 420 with energy when the electric machine 202 is driven by its associated pump 204 and functions as a generator.

The wheel loader 101 also comprises a power source 422 in the form of an internal combustion engine, which usually comprises a diesel engine, for propulsion of the vehicle. The diesel engine is connected in a driving manner to the wheels of the vehicle via a drive line (not shown). The diesel engine is moreover connected to the energy storage means 420 via a generator (not shown) for energy transmission.

It is possible to imagine alternative machines/units adapted for generating electric power. According to a first alternative, use is made of a fuel cell which provides the electric machine with energy. According to a second alternative, use is made of a gas turbine with an electric generator for providing the electric machine with energy.

FIG. 4 also shows the other components which are connected to the control unit 402 according to the first embodiment of the control system for the lifting function, see FIG. 2, such as the electrically controlled valves 224, 237, 243, the position sensor 248 and the pressure sensor 228.

The invention is not to be regarded as being limited to the illustrative embodiments described above, but a number of further variants and modifications are conceivable within the scope of the following patent claims.

According to an alternative to a second port on the hydraulic machine being connected to the piston-rod side of the hydraulic cylinder via a second line, the piston-rod side can be connected to the tank.

According to an alternative, a parameter is detected that is indicative of a different function than the function that is to be sprung/damped and the springing/damping is controlled correspondingly. For example, a steering movement is detected (via the steering cylinders 104, 105) and the springing/damping of the lift function (via the lifting cylinders 108, 109) is controlled correspondingly.

The invention claimed is:

1. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, wherein the hydraulic machine is adapted, in a first mode of operation, to pump hydraulic fluid to the hydraulic cylinder and, in a second mode of operation, to be driven as a hydraulic motor by hydraulic fluid from the hydraulic cylinder.

2. The method as claimed in claim 1, comprising controlling the hydraulic machine in such a way that the springing of the movement of the implement is achieved.

3. The method as claimed in claim 1, comprising detecting a parameter that is indicative of a position of the implement and controlling the hydraulic machine in response to the detected position.

4. The method as claimed in claim 3, comprising detecting the position parameter repeatedly.

5. The method as claimed in claim 1, comprising pressurizing the hydraulic cylinder to such an extent that the implement is brought to a home position.

6. The method as claimed in claim 5, comprising continuously controlling the hydraulic machine so that the implement is kept within a predetermined range around the home position.

7. The method as claimed in claim 1, comprising detecting a parameter that is indicative of a position of the implement upon initiation of the method, defining the detected position upon initiation as a home position and controlling the hydraulic machine, when the hydraulic machine is connected to the hydraulic cylinder, in such a way that the implement is kept in the home position.

8. The method as claimed in claim 1, comprising supplying a corresponding quantity of hydraulic fluid to the hydraulic cylinder, in the event of a disturbance that results in an upward movement of the implement.

9. The method as claimed in claim 1, comprising draining at least a corresponding quantity of hydraulic fluid from the hydraulic cylinder, in the event of a disturbance that results in a downward movement of the implement.

10. The method as claimed in claim 1, comprising connecting a first port on the hydraulic machine in communication with a piston side of the hydraulic cylinder via a first line.

11. The method as claimed in claim 1, comprising connecting a second port on the hydraulic machine in communication with a piston-rod side of the hydraulic cylinder via a second line.

12. The method as claimed in claim 1 comprising controlling the hydraulic machine via an electric machine.

13. The method as claimed in claim 1, comprising detecting at least one operating parameter and controlling the springing movement according to a function in response to the detected operating parameter.

14. The method as claimed, in claim 13, comprising detecting a level of disturbance force and controlling the springing and/or damping in response to a level of the disturbance force acting upon the implement.

15. The method as claimed in claim 13, comprising detecting a parameter that is indicative of a position of the implement and controlling the springing and/or damping in response to the position.

16. The method as claimed in claim 1, comprising detecting at least one operating parameter and controlling damping in response to the detected operating parameter.

17. The method as claimed in claim 1, comprising opening a valve on a piston side or piston-rod side of the hydraulic cylinder in order to connect the hydraulic machine to the hydraulic cylinder.

18. The method as claimed in claim 1, comprising recording a disturbance via a position sensor for a function that is controlled by the hydraulic cylinder.

19. The method as claimed in claim 18, comprising recording a disturbance via a pressure sensor for a function that is controlled by the hydraulic cylinder.

20. The method as claimed in claim 1, in which the hydraulic cylinder constitutes a lifting cylinder and is connected to the implement via a load arm.

21. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, allowing the hydraulic machine to be driven by a flow of hydraulic fluid from the hydraulic cylinder, in the event of a disturbance that results in a downward movement of the implement, and regenerating the energy from the hydraulic machine.

22. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, detecting at least one operating parameter and controlling the springing movement according to a function in response to the detected operating parameter, detecting a weight of a load, and controlling the springing and/or damping in response to the weight.

23. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, detecting at least one operating parameter and controlling the springing movement according to a function in response to the detected operating parameter, determining which type of implement is being used, and controlling the springing and/or damping depending upon the type of implement.

24. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, detecting at least one operating parameter and controlling the springing movement according to a function in response to the detected operating parameter, determining the type of work being carried out, and controlling the springing and/or damping depending upon the work being carried out.

25. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, detecting at least one operating parameter and controlling the springing movement according to a function in response to the detected operating parameter, detecting a parameter that is indicative of a different function than a function for which the hydraulic machine is arranged to supply pressure, and controlling the springing and/or damping in response to the detected parameter.

26. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, detecting at least one operating parameter and controlling the springing movement according to a function in response to the detected operating parameter, detecting a speed of the work machine, and controlling the springing and/or damping in response to the speed.

27. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, wherein the hydraulic cylinder is a tilting cylinder.

28. A method for springing a movement of an implement of a work machine during a movement of the work machine, in which at least one hydraulic cylinder is operatively connected to the implement, comprising connecting a hydraulic machine to communication with the hydraulic cylinder, and controlling the hydraulic machine in response to a disturbance of the implement during the movement, wherein the hydraulic cylinder is a steering cylinder.

* * * * *